US007441670B2

(12) United States Patent
Willim

(10) Patent No.: US 7,441,670 B2
(45) Date of Patent: Oct. 28, 2008

(54) DERRICK CRANE

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 11/059,959

(22) Filed: Feb. 17, 2005

(65) Prior Publication Data

US 2005/0194339 A1 Sep. 8, 2005

(30) Foreign Application Priority Data

Feb. 17, 2004 (DE) ..... 20 2004 002 424 U

(51) Int. Cl.
*B66C 23/82* (2006.01)

(52) U.S. Cl. ..... 212/300; 212/239; 212/262

(58) Field of Classification Search ..... 212/298–300, 212/230–231, 239, 262
See application file for complete search history.

(56) References Cited

U.S. PATENT DOCUMENTS 2,443,306 A * 6/1948 De Cuir ..... 212/299
3,072,265 A * 1/1963 Nickles ..... 212/239
3,209,920 A * 10/1965 De Cuir ..... 212/239
3,252,585 A * 5/1966 Wieschel ..... 212/295
4,159,776 A * 7/1979 Holter ..... 212/239
4,194,638 A * 3/1980 Morrow et al. ..... 212/239
4,381,060 A * 4/1983 Morrow et al. ..... 212/195
4,446,976 A * 5/1984 Imerman et al. ..... 212/304
4,557,390 A * 12/1985 Mick ..... 212/197

FOREIGN PATENT DOCUMENTS

| | | |
|---|---|---|
| DE | 3640068 | 7/1987 |
| DE | 29624267 | 6/2001 |
| DE | 20108816 | 7/2002 |

* cited by examiner

*Primary Examiner*—Thomas J. Brahan
(74) *Attorney, Agent, or Firm*—Dilworth & Barrese, LLP

(57) ABSTRACT

The invention relates to a derrick crane having a main boom and having a derrick boom which are connected to one another by a stay cable to guy the main boom, having an auxiliary tip adjoining the main boom and a stay cable for its guying. In accordance with the invention, the stay cable of the auxiliary tip engages at the auxiliary tip at the one end and at the stay cable of the main boom at the other end.

18 Claims, 2 Drawing Sheets

DERRICK CRANE

BACKGROUND OF THE INVENTION

The present invention relates to a derrick crane having a main boom and having a derrick boom, which are connected to one another by a stay cable to guy the main boom, having an auxiliary tip adjoining the main boom and a stay cable for its guying.

Such a derrick crane is shown by way of example in FIG. 1. The derrick crane has the main boom 10 and the derrick boom 20 between which the stay cable 30 for the guying of the main boom 10 extends. The derrick boom 20 is guyed to the ballast weight 130 via the stay 132 and to the ballast weight 120 via the stay 122.

The main stay 30 has the adjustment cable 70 which runs off from an adjustment cable winch and runs via a return pulley 82 fixed to the derrick boom tip and via a free adjustment pulley 80. The stay cable 90 is secured to the latter and extends up to the tip of the main boom 10.

As can further be seen from FIG. 1, the additional stay 60, which is fixed to the main boom 10, branches off from the stay cable 90.

The short auxiliary tip 40 adjoins the upper end region of the main boom 10 and has return pulleys via which the lifting cable 140 is guided. The hook 150 is located at the end of the latter.

As can be seen from FIG. 1, the short auxiliary tip 40 is guyed by means of the stay cable 50 which extends from the tip of the short auxiliary tip 40 to the main boom 10 via a stay support 100. The return stay, i.e. the stay 50 of the short auxiliary tip 40, is secured in the upper region of the main boom 10, as can be seen from FIG. 1.

SUMMARY OF THE INVENTION

Derrick cranes are frequently used to lift particularly heavy loads independently of their specific embodiment. The maximum working load is substantially determined by the forces which can be taken up by the main boom 10. It is the underlying object of the present invention to achieve an increase in the working load in a derrick crane of the kind first mentioned.

This object is solved by a derrick crane having the features in accordance herein. It is accordingly provided that the stay cable of the auxiliary tip engages at the auxiliary tip at the one end, and at the stay cable of the main boom at the other end. In contrast to the already known arrangement shown in FIG. 1, the return stay of the short auxiliary tip is not secured directly to the boom, but rather engages at the stay cable of the main boom. The advantage of this stay lies in the fact that the pressure load in the upper region of the main boom is reduced by this stay. An increase in working load of approximately 4 to 5% is possible thereby.

Provision is made in a further aspect of the invention for an additional stay to be provided between the stay cable of the main boom and the main boom and for the stay cable of the auxiliary tip to engage at that point of the stay of the main boom at which the additional stay also-engages. It is thereby ensured that no angle change of the short auxiliary tip occurs on the taking up of the load.

The stay cable of the main boom can have an adjustment cable for the length adjustment of the stay of the main boom and for the adjustment of the main boom.

Provision can be made for the adjustment cable to be reeved via an adjustment pulley to which a stay cable is secured which is fixed to the main boom at its other end. The stay cable preferably engages at the tip of the main boom.

Provision can be made in a further development of the present invention for a return pulley to be provided which is longitudinally displaceably seated on the stay cable and via which the adjustment cable runs to the main boom and for the stay cable of the auxiliary tip to engage at the return pulley. In this case, the additional stay is formed by the adjustment cable which is guided to the main boom via the return pulley longitudinally displaceably seated on the stay cable. It is naturally equally possible for the additional stay not to be formed by the adjustment cable.

The auxiliary tip is preferably arranged in the upper end region of the main boom. The stay cable of the auxiliary tip in a preferred aspect of the invention is guided from its end region facing away from the main boom to the stay cable of the main boom via a stay support. The stay support preferably extends from the upper region of the main boom.

Provision is made in a further embodiment of the invention for the additional stay to be connected to the main boom in its upper half facing the boom tip. Embodiments different from this are generally also feasible. It is, for example, possible to provide not only one additional stay, but rather a plurality of additional stays which can be connected to the main boom in different regions.

BRIEF DESCRIPTION OF THE DRAWINGS

Further details of the invention will be explained in more detail with reference to an embodiment shown in the drawing. There are shown.

DESCRIPTION OF THE PREFERRED EMBODIMENTS

Figure 1:
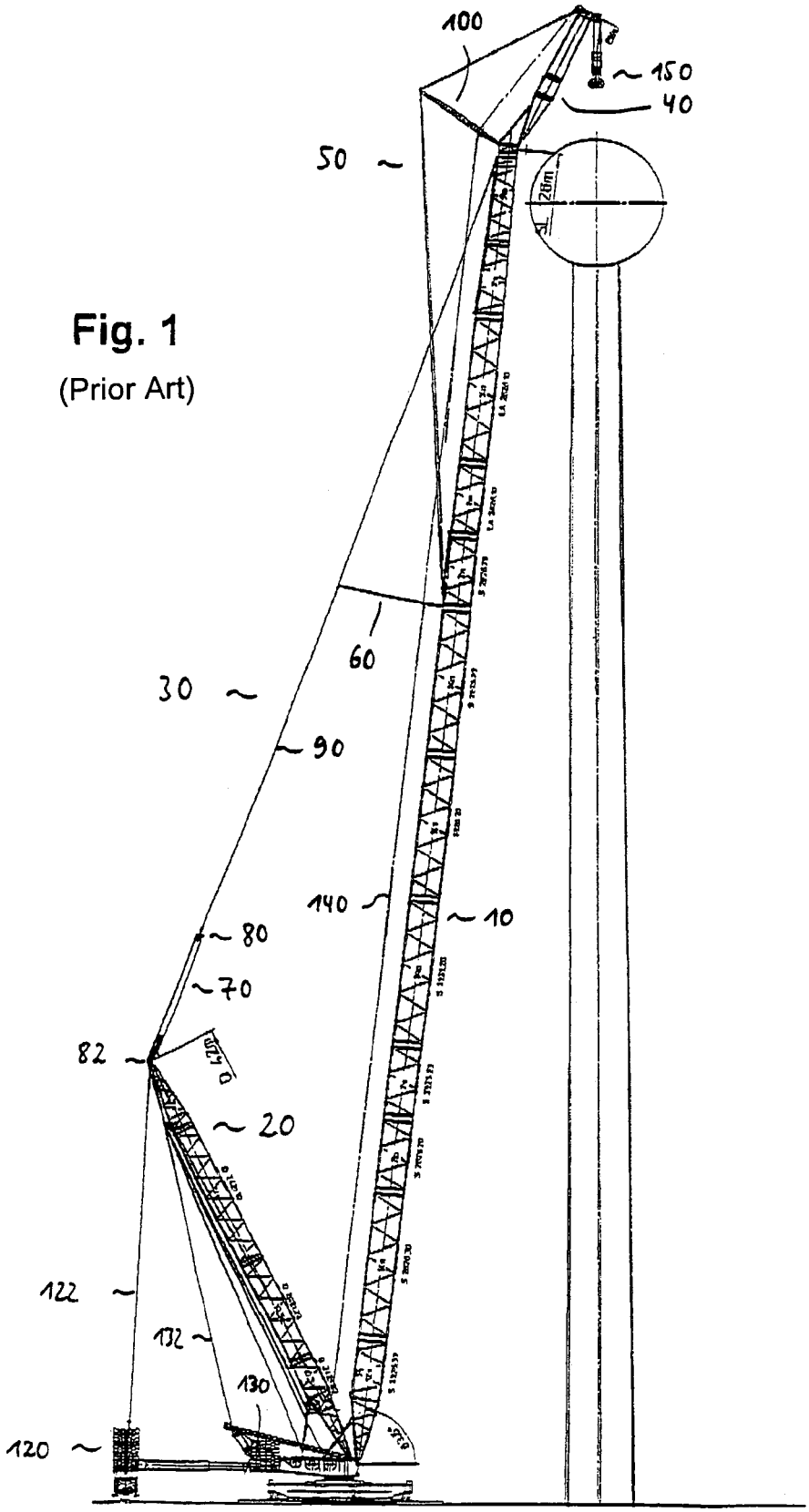
Fig. 1 (Prior Art)
FIG. 1: a derrick crane in accordance with the prior art.
Figure 2:
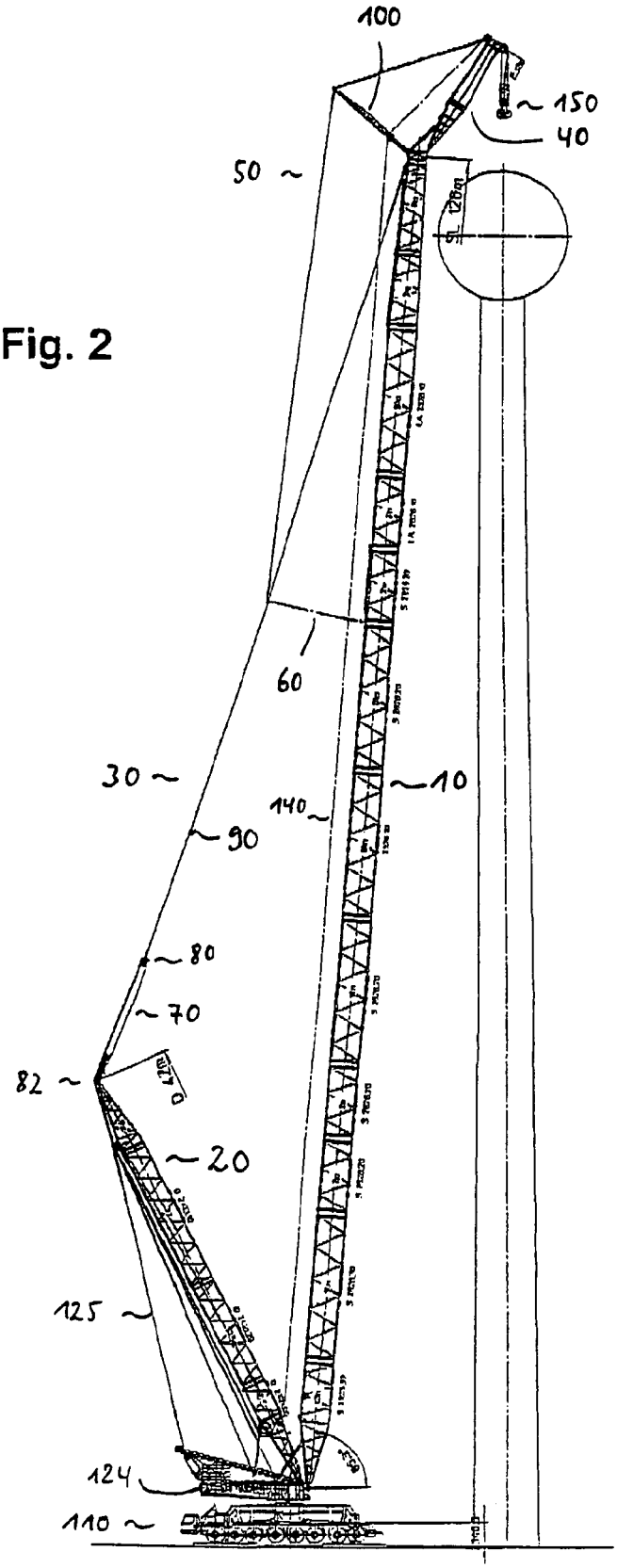
FIG. 2: a derrick crane in accordance with the present invention.

The derrick crane of the present invention shown in FIG. 2 is designed as a mobile crane 110. The main boom 10, which is luffable about a horizontal axis, and the derrick boom 20, which is likewise pivotable about a horizontal axis, extend therefrom. The derrick boom 20 is guyed to the ballast weight 124 of the mobile crane 110 by means of the stay cable 125. The stay cable 125 engages in the region of the derrick boom tip. The stay cable 30, which consists of the adjustment cable 70 and the stay cable 90, extends between the tip of the derrick boom 20 and the tip of the main boom 10. The adjustment cable 70 runs off from an adjustment winch and is guided via the return pulley 82 and the free adjustment pulley 80. The stay cable 90, which is fixed in its other end region to the tip of the main boom 10, engages at the adjustment pulley 80.

As can further be seen from FIG. 2, the additional stay 60 branches off from the stay cable 80 and is connected to the main boom 10 in its upper half directed to the boom tip.

The short auxiliary tip 40 is arranged at the tip of the main boom 10. It has the stay 50 which extends from the tip of the short auxiliary tip 40 facing away from the main boom 10 up to that point at which the additional stay 60 branches off from the stay cable 90 or from the stay cable 30 of the main boom 10, as can be seen from FIG. 2.

The stay cable 50 of the short auxiliary tip 40 is guided via the stay support 100 which extends from the main boom 10 in the upper end region thereof.

A lifting cable 140 is guided via return pulleys at the stay support 100 and at the short auxiliary tip 40. The lifting cable 140 supports the hook 150 at its end region.

The return stay of the short auxiliary tip 40 is visible from FIG. 2 and is connected to the main stay between the head of the derrick boom 20 and the head of the main boom 10 at that point at which the additional stay 60 also engages; it brings along the advantage that, on the taking up of the load, no angle change results at the short tip 40 and, furthermore, that the pressure load is reduced in the upper region of the boom 10 by this stay 50. The reduction in the pressure load permits an increase in the working load of the derrick crane of approximately 4 to 5%.

The invention claimed is:

1. A derrick crane having a main boom (10), an auxiliary boom (40) connected to a tip of the main boom (10) at a joint therebetween, said auxiliary boom (40) having a portion at which a lifting cable is disposed, a derrick boom (20), a stay cable assembly (30) to guy the main boom (10), said stay cable assembly (30) being attached at a first connection point to the main boom (10) and at a second connection point to the derrick boom (20) without boom strut(s) in the stay cable assembly (30) between said first and second connection points, a first auxiliary stay cable (50) attached to the auxiliary boom (40) and extending from the auxiliary boom (40) to the stay cable assembly (30) wherein the first auxiliary stay cable (50) is attached to and terminates at the stay cable assembly (30) at a connection point of the first auxiliary stay cable (50) between first and second ends of the stay cable assembly (30), and an additional auxiliary stay cable (60) being provided between the connection point of the first auxiliary stay cable (50) on stay cable assembly (30) and the main boom (10).

2. A derrick crane in accordance with claim 1, wherein the stay cable assembly (30) includes an adjustment cable (70) for the length adjustment of the stay cable assembly (30) and a stay cable portion (90), wherein the connection point of the first auxiliary cable (50) is on stay cable portion (90).

3. A derrick crane in accordance with claim 2, wherein the auxiliary boom (40) is attached at an end portion to an upper end region of the main boom (10).

4. A derrick crane in accordance with claim 3, wherein the first auxiliary stay cable (50) is guided from the portion of the auxiliary boom (40) at which the lifting cable is disposed to the stay cable portion (90) via a stay support (100).

5. A derrick crane in accordance with claim 2, wherein the first auxiliary stay cable (50) is guided from the portion of the auxiliary boom (40) at which the lifting cable is disposed to the stay cable portion (90) via a stay support (100).

6. A derrick crane in accordance with claim 2, wherein an upper end of the stay cable portion (90) is attached to the main boom (10) and a lower end of the stay cable portion (90)is engaged with an adjustment pulley (80), and wherein the adjustment cable (70) extends between the adjustment pulley (80) and a return pulley (82) disposed on the tip of the derrick boom (20).

7. A derrick crane in accordance with claim 2, wherein the stay cable assembly (30) includes an adjustment pulley (80), wherein the adjustment cable (70) is reeved via the adjustment pulley (80), and wherein the stay cable portion (90) is secured at one end to the adjustment pulley (80) and is fixed at its other end to the main boom (10).

8. A derrick crane in accordance with claim 7, wherein the auxiliary boom (40) is attached at an end portion to an upper end region of the main boom (10).

9. A derrick crane in accordance with claim 7, wherein the first auxiliary stay cable (50) is guided from the portion of the auxiliary boom (40) at which the lifting cable is disposed to the stay cable portion (90) via a stay support (100).

10. A derrick crane in accordance with claim 7, further including a return pulley (82) attached to the upper end of the derrick boom wherein the adjustment cable (70) of the stay cable assembly (30) extends from the return pulley (82) to the adjustment pulley (80).

11. A derrick crane in accordance with claim 10, wherein the auxiliary boom (40) is attached at an end portion to an upper end region of the main boom (10).

12. A derrick crane in accordance with claim 10, wherein the first auxiliary stay cable (50) is guided from the portion of the auxiliary boom (40) at which the lifting cable is disposed to the stay cable portion (90) via a stay support (100).

13. A derrick crane in accordance with claim 1, wherein the auxiliary boom (40) is attached at an end portion to an upper end region of the main boom (10).

14. A derrick crane in accordance with claim 13, wherein the first auxiliary stay cable (50) is guided from the portion of the auxiliary boom (40) at which the lifting cable is disposed to the stay cable portion (90) via a stay support (100).

15. A derrick crane in accordance with claim 1, wherein the first auxiliary stay cable (50) is guided from the portion of the auxiliary boom (40) at which the lifting cable is disposed to the stay cable assembly (30) via a stay support (100).

16. A derrick crane in accordance with claim 15, wherein the stay support (100) extends from an upper end region of the main boom (10).

17. A derrick crane in accordance with claim 1, wherein the additional stay (60) is connected to an upper half of the main boom (10).

18. A derrick crane having:

a main boom (10) having an auxiliary tip (40) adjoining the main boom (10), said auxiliary tip (40) having a portion at which the a lifting cable is disposed, a derrick boom (20), a stay cable assembly (30) to guy the main boom (10), said stay cable assembly being attached at a first end to the main boom (10) and at a second end to the derrick boom (20), an auxiliary stay cable (50) extending from the auxiliary tip (40) to the stay cable assembly (30), wherein the auxiliary stay cable (50) is attached to the stay cable (30) at a connection point between the first and second ends of the stay cable assembly (30), and an additional auxiliary stay cable (60) being provided between the connection point of the auxiliary stay cable (50) and the stay cable assembly (30) and the main boom (10).

* * * * *